US011764521B2

(12) United States Patent
Huang et al.

(10) Patent No.: US 11,764,521 B2
(45) Date of Patent: Sep. 19, 2023

(54) BOARD END CONNECTOR AND CONNECTOR ASSEMBLY

(71) Applicant: Dongguan Luxshare Technologies Co., Ltd, Dongguan (CN)

(72) Inventors: Bin Huang, Dongguan (CN); HongJi Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 18/073,053

(22) Filed: Dec. 1, 2022

(65) Prior Publication Data

US 2023/0101056 A1 Mar. 30, 2023

Related U.S. Application Data

(63) Continuation of application No. 17/379,594, filed on Jul. 19, 2021.

(30) Foreign Application Priority Data

Dec. 16, 2020 (CN) ..... 202011489361.9

(51) Int. Cl.

| | |
|---|---|
| ***H01R 12/70*** | (2011.01) |
| ***H01R 13/639*** | (2006.01) |
| ***H01R 12/71*** | (2011.01) |
| ***H01R 12/75*** | (2011.01) |
| ***H01R 12/79*** | (2011.01) |
| ***H01R 13/629*** | (2006.01) |

(52) U.S. Cl.
CPC ..... *H01R 13/639* (2013.01); *H01R 12/716* (2013.01); *H01R 12/75* (2013.01); *H01R 12/79* (2013.01); *H01R 13/629* (2013.01)

(58) Field of Classification Search
CPC .... H01R 13/639; H01R 12/716; H01R 12/75; H01R 12/79; H01R 13/629
See application file for complete search history.

(56) References Cited

U.S. PATENT DOCUMENTS

| | | | |
|---|---|---|---|
| 6,447,170 | B1 | 9/2002 | Takahashi et al. |
| 6,851,867 | B2 | 2/2005 | Pang et al. |
| 7,040,911 | B1 | 5/2006 | Ho et al. |
| 7,090,523 | B2 | 8/2006 | Shirk et al. |

(Continued)

*Primary Examiner* — Abdullah A Riyami
*Assistant Examiner* — Nelson R. Burgos-Guntin
(74) *Attorney, Agent, or Firm* — Birch, Stewart, Kolasch & Birch, LLP

(57) ABSTRACT

A board end connector and a connector assembly are provided. The board end connector comprises a board end connector body and a board end housing. The board end housing comprises a board end accommodating part and a buckling slot. Wherein the board end accommodating part accommodates the board end connector body. An end surface of the board end accommodating part in the first direction comprises a board end opening. The buckling slot is disposed at one side of the board end accommodating part. A buckling bump is provided in the buckling slot. A sidewall of the buckling bump in a second direction orthogonal to the first direction and away from the board end accommodating part comprises a board end buckling part. The board end buckling part comprises a retaining opening and a buckling elastic piece.

8 Claims, 11 Drawing Sheets

(56) References Cited

U.S. PATENT DOCUMENTS 7,108,523 B2 9/2006 Hartman
7,429,185 B1 9/2008 Wu
8,113,723 B2 2/2012 Togami et al.
8,348,701 B1 * 1/2013 Lan ..... H01R 12/716 439/607.19
8,506,172 B2 8/2013 Meadowcroft et al.
8,545,252 B2 10/2013 Wang et al.
8,790,022 B2 7/2014 Yi
9,001,515 B2 4/2015 Tang et al.
9,118,149 B2 8/2015 Kappla et al.
9,250,402 B2 2/2016 Ishii et al.
9,306,303 B2 4/2016 Chen et al.
9,348,101 B2 5/2016 Wang et al.
9,385,466 B2 * 7/2016 Henry ..... H01R 13/5845
9,411,111 B2 8/2016 Banal, Jr. et al.
9,774,113 B2 9/2017 Zhang et al.
9,801,301 B1 10/2017 Costello
9,829,662 B2 11/2017 Kurashima
9,929,500 B1 3/2018 Ista
10,236,605 B1 * 3/2019 Henry ..... H01R 12/732
10,454,194 B1 * 10/2019 Phillips ..... H05K 1/117
10,606,001 B1 3/2020 Ko
10,855,028 B1 * 12/2020 Henry ..... H01R 13/6272
11,171,445 B1 11/2021 Shen et al.
11,189,971 B2 * 11/2021 Lu ..... H01R 12/75
11,196,213 B2 12/2021 Shen et al.
11,228,140 B2 1/2022 Hsiao et al.
11,303,065 B2 * 4/2022 Wang ..... H01R 12/71
2006/0078259 A1 4/2006 Fuchs
2006/0160429 A1 * 7/2006 Dawiedczyk ..... H01R 12/727 439/676
2010/0062650 A1 * 3/2010 Nakamura ..... H01R 13/64 439/65
2013/0040482 A1 * 2/2013 Ngo ..... H01R 12/7023 439/328
2013/0040485 A1 * 2/2013 Ngo ..... H01R 12/75 439/350
2014/0193993 A1 7/2014 Meng et al.
2015/0044913 A1 2/2015 Chen
2015/0255922 A1 9/2015 Kawamura et al.
2017/0194741 A1 7/2017 Zhang et al.
2018/0034211 A1 2/2018 Little et al.
2018/0040977 A1 2/2018 Zhao et al.
2019/0173232 A1 * 6/2019 Lu ..... H01R 13/6594
2019/0372251 A1 * 12/2019 Huang ..... H01R 12/79
2019/0372256 A1 * 12/2019 Phillips ..... H01R 12/7005
2020/0244025 A1 7/2020 Winey et al.
2020/0259294 A1 * 8/2020 Lu ..... H01R 12/57
2020/0321727 A1 10/2020 Li et al.
2020/0335914 A1 * 10/2020 Hsu ..... H01R 12/716
2020/0358224 A1 11/2020 Chan
2020/0366016 A1 * 11/2020 Hsiao ..... H01R 13/6583
2021/0013649 A1 1/2021 Costello et al.
2021/0098913 A1 4/2021 Hsu et al.
2021/0166834 A1 6/2021 Tanaka et al.
2021/0167535 A1 * 6/2021 Tanaka ..... H01R 12/79
2021/0305732 A1 9/2021 Chen
2021/0336386 A1 10/2021 Wu et al.
2021/0351531 A1 11/2021 Chen
2022/0045459 A1 2/2022 Lin et al.
2022/0052487 A1 2/2022 Chang
2022/0059958 A1 2/2022 Hsu et al.
2022/0109260 A1 4/2022 Sato
2022/0190511 A1 6/2022 Huang et al.
2022/0190513 A1 6/2022 Henry et al.
2022/0190522 A1 6/2022 Huang et al.
2022/0200190 A1 6/2022 Song et al.
2022/0231464 A1 7/2022 Chen et al.

* cited by examiner

BOARD END CONNECTOR AND CONNECTOR ASSEMBLY

CROSS-REFERENCE TO RELATED APPLICATION

This application is a Continuation Application of U.S. patent application Ser. No. 17/379,594, filed on Jul. 19, 2021, which claims the priority benefit of China Patent Application Serial Number 202011489361.9, filed on Dec. 16, 2020. These and all other referenced extrinsic materials are incorporated herein by reference in their entirety.

BACKGROUND

Technical Field

The present disclosure relates to the technical field of connector, particularly to a board end connector and a connector assembly.

Related Art

Conventional board end connectors usually comprise a board end connector body and a locking part disposed on the top surface of the board end connector body. When a wire end connector is connected to the board end connector, the wire end connector would be connected to the locking part of the board end connector through a puller unlocking component. Since the locking part is disposed on the top surface of the board end connector body, the thickness of the board-end connector is increased, which is not favorable for the thinning of the board end connector. Besides, the configuration of the locking part is quite complicated due to the puller unlocking component, making it difficult to manufacture.

SUMMARY

The embodiments of the present disclosure provide a board end connector and a connector assembly tended to solve the problem that the board end connector cannot be thinned as the locking part of conventional board end connectors is disposed on the top surface of the board end connector body.

In one embodiment, a board end connector is provided, comprising a board end connector body and a board end housing. The board end housing comprises a board end accommodating part and a buckling slot. Wherein the board end accommodating part accommodates the board end connector body. An end surface of the board end accommodating part in the first direction comprises a board end opening. The buckling slot is disposed at one side of the board end accommodating part. A buckling bump is provided in the buckling slot. A sidewall of the buckling bump in a second direction orthogonal to the first direction and away from the board end accommodating part comprises a board end buckling part. The board end buckling part comprises a retaining opening and a buckling elastic piece. One end of the buckling elastic piece is connected with a side edge of the retaining opening in the first direction and close to the board end accommodating part. The other end of the buckling elastic piece extends in a direction away from the board end accommodating part. The other end of the buckling elastic piece is inclined to a sidewall of the corresponding buckling slot in the second direction and away from the board end accommodating part. The other end of the buckling elastic piece is bent into the buckling slot.

In another embodiment, a connector assembly is provided, comprising a board end connector according to the above embodiment and a wire end connector. The wire end connector comprises a wire end connector body, a wire end housing accommodating the wire end connector body, and an unlocking member. The wire end housing comprises two buckling bumps. The outer surfaces of the two buckling bumps in the second direction respectively comprise a buckling recess. The unlocking member is disposed at one side of the wire end housing. The unlocking member comprises two unlocking arms respectively disposed in the two buckling bumps. The outer side edges of the two unlocking arms in the second direction respectively comprise a wire end buckling part and an unlocking part. The wire end buckling part corresponds to the buckling recess. Wherein, when the wire end connector is connected to the board end connector, the two buckling bumps would be respectively disposed in the buckling slot. The buckling elastic piece of the board end buckling part would be disposed in the buckling recess and corresponds to the wire end buckling part. When the unlocking member moves in a direction away from the board end connector, the unlocking part would pass through the buckling recess and pushes the buckling elastic piece.

In the embodiments of the present disclosure, the buckling slot of the board end connector is disposed at one side of the board end connector body. The buckling slot is provided for insertion of the two buckling bumps and two unlocking arms of the wire end connector. The two board end buckling parts, the buckling recesses of the two buckling bumps, and the wire end buckling parts and the unlocking parts of the two unlocking arms horizontally move. Thus, the thickness of the board end connector in the vertical direction would not be increased, allowing the thickness of the board end connector to be thinned.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
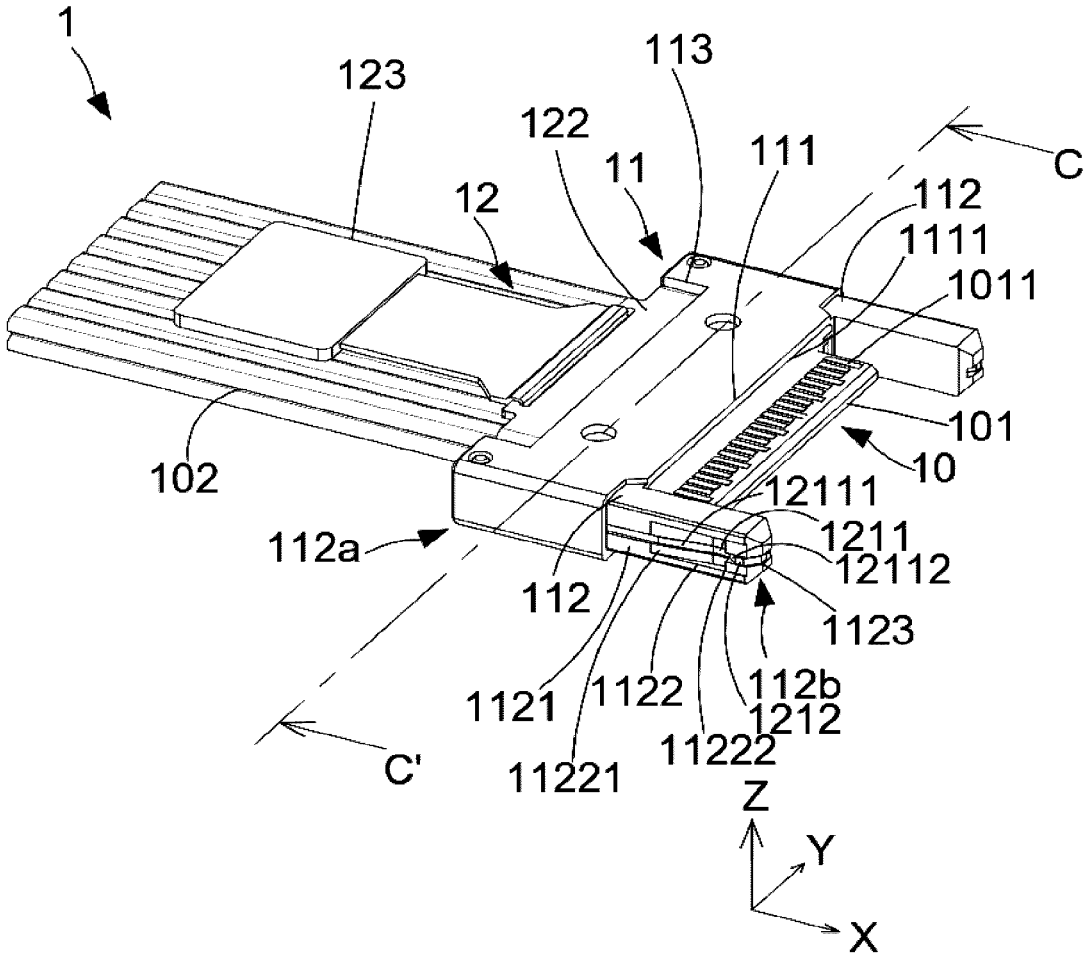
FIG. 1 is a perspective view of a wire end connector of an embodiment of the present disclosure.
Figure 2:
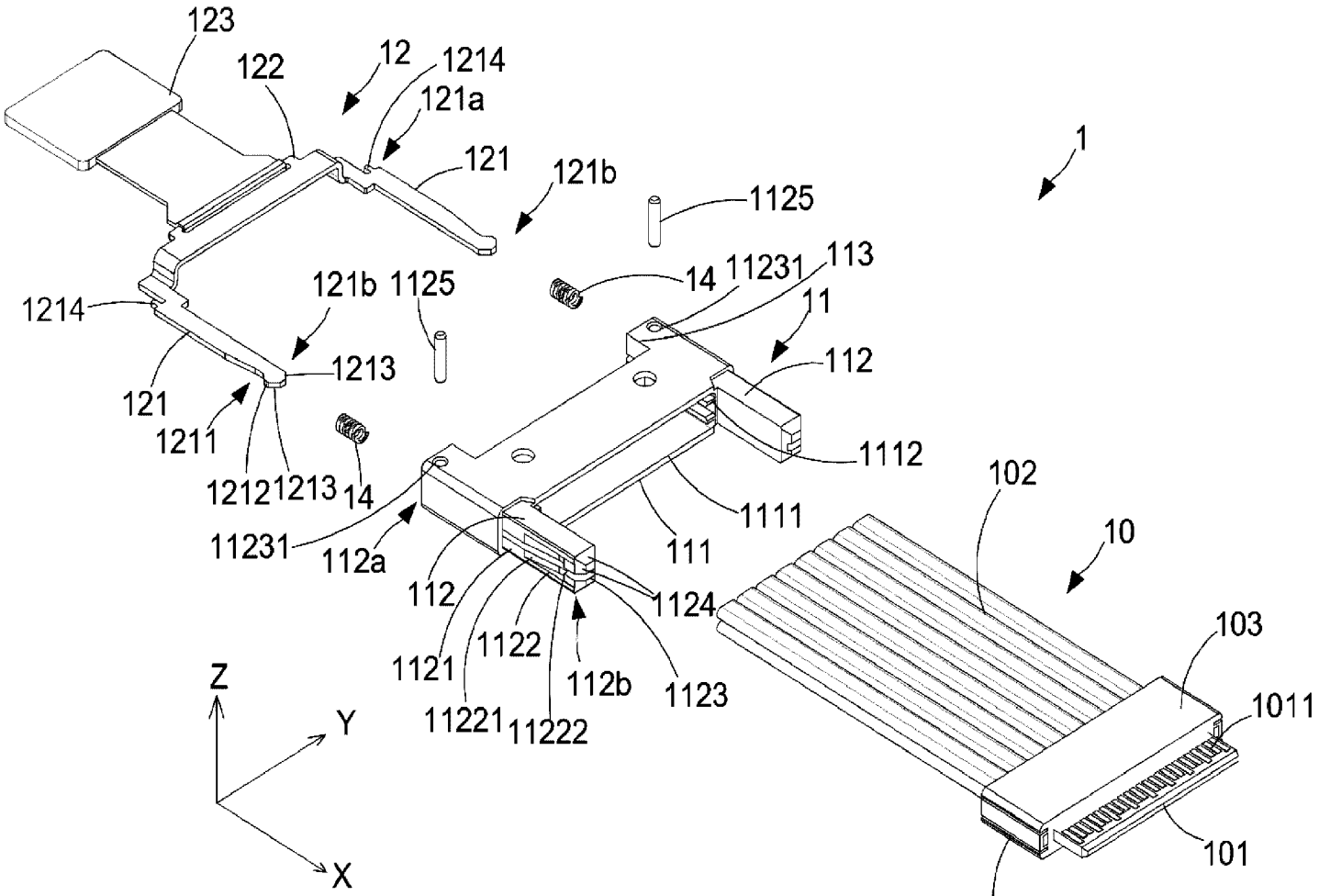
FIG. 2 is an exploded view of a wire end connector of an embodiment of the present disclosure.

FIG. 1 and FIG. 2 are perspective view and exploded view of a wire end connector of an embodiment of the present disclosure. As shown in the figures, in this embodiment, the wire end connector 1 comprises a wire end connector body 10, a wire end housing 11, and an unlocking member 12. The wire end housing 11 comprises a wire end accommodating part 111 and two buckling bumps 112. An end surface of the wire end accommodating part 111 in the first direction X comprises a wire end opening 1111. The two buckling bumps 112 are oppositely disposed on two sides of the wire end accommodating part 111. The two buckling bumps 112 respectively comprise a first end 112*a* and a second end 112*b*. The first ends 112*a* of the two buckling bumps 112 are close to one side of the wire end housing 11 away from the wire end opening 1111. The second ends 112*b* of the two buckling bumps 112 respectively protrude from one end of the wire end accommodating part 111 comprising the wire end opening 1111 in the first direction X.

An outer surface 1121 of the two buckling bumps 112 in the second direction Y respectively comprise a buckling recess 1122. The buckling recesses 1122 of the two buckling bumps 112 are respectively disposed between the wire end accommodating part 111 and the second ends 112*b* of the two buckling bumps 112. The wire end connector body 10 is disposed in the wire end accommodating part 111 of the wire end housing 11. The unlocking member 12 comprises two opposite unlocking arms 1211 and is disposed at one side of the wire end housing 11 away from the wire end opening 1111. The two unlocking arms 121 are movably disposed in the two buckling bumps 112 respectively. The two unlocking arms 121 respectively comprise a connecting end 121*a* and a buckling end 121*b*. The connecting ends 121*a* of the two unlocking arms 121 are respectively disposed at the first ends 112*a* of the two buckling bumps 112. The buckling ends 121*b* of the two unlocking arms 121 are respectively disposed at the second ends 112*b* of the two buckling bumps 112. The two unlocking arms 121 respectively protrude from one end of the wire end accommodating part 111 comprising the wire end opening 1111 in the first direction X.

The outer side edges of the two unlocking arms 121 in the second direction Y and away from the wire end accommodating part 111 comprise a wire end buckling part 1211 and an unlocking part 1212 respectively. The wire end buckling parts 1211 of the two unlocking arms 121 respectively correspond to the buckling recesses 1122 of the two buckling bumps 112. The unlocking parts 1212 of the two unlocking arms 121 are respectively disposed at one side of the buckling recesses 1122 of the two buckling bumps 112. The unlocking parts 1212 of the two unlocking arms 121 are respectively farther than the wire end buckling parts 1211 of the two unlocking arms 121 away from the wire end accommodating part 111. Wherein the second direction Y is orthogonal to the first direction X.

Figure 3:
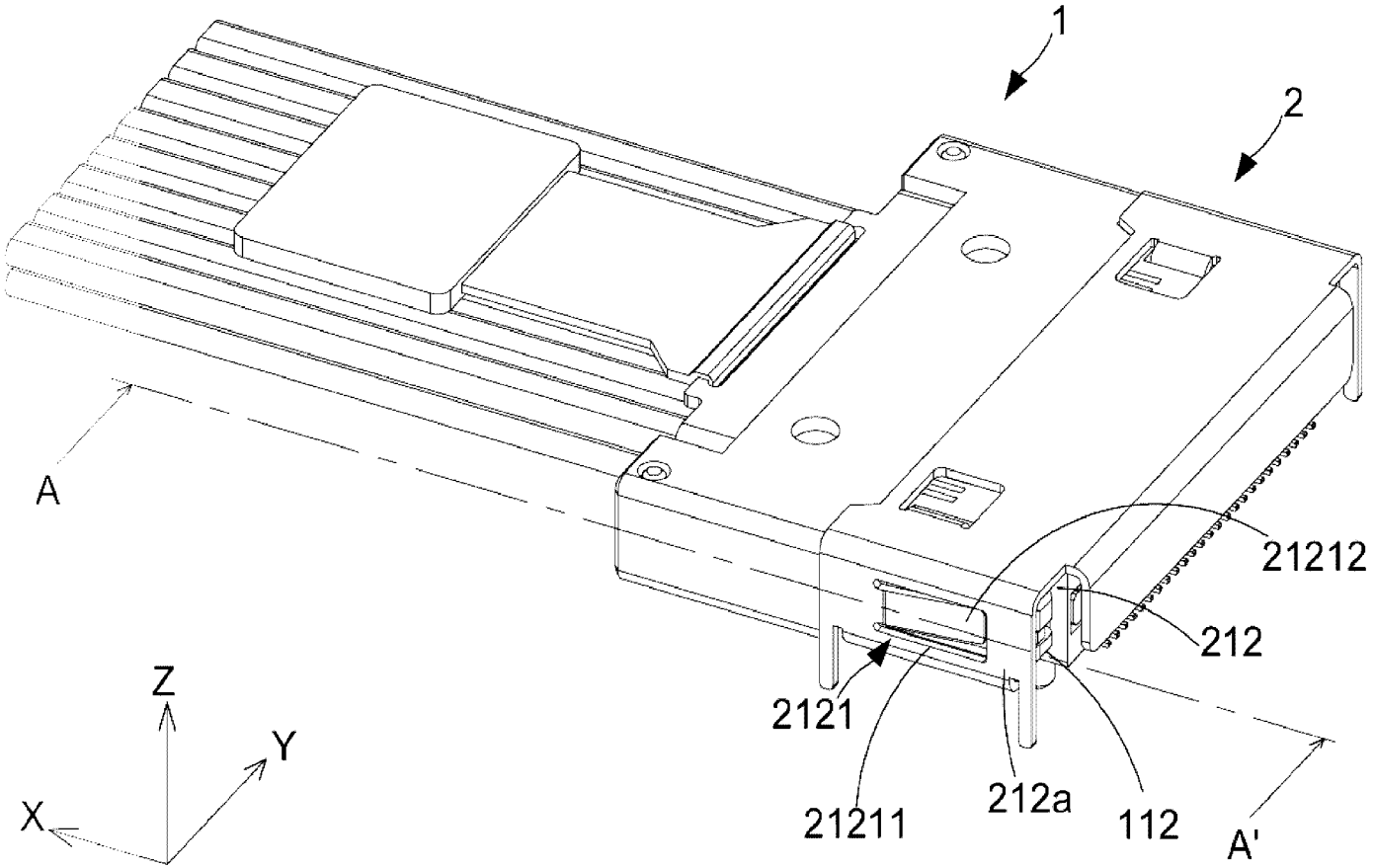
FIG. 3 is a perspective view of a connector assembly of an embodiment of the present disclosure.
Figure 4:
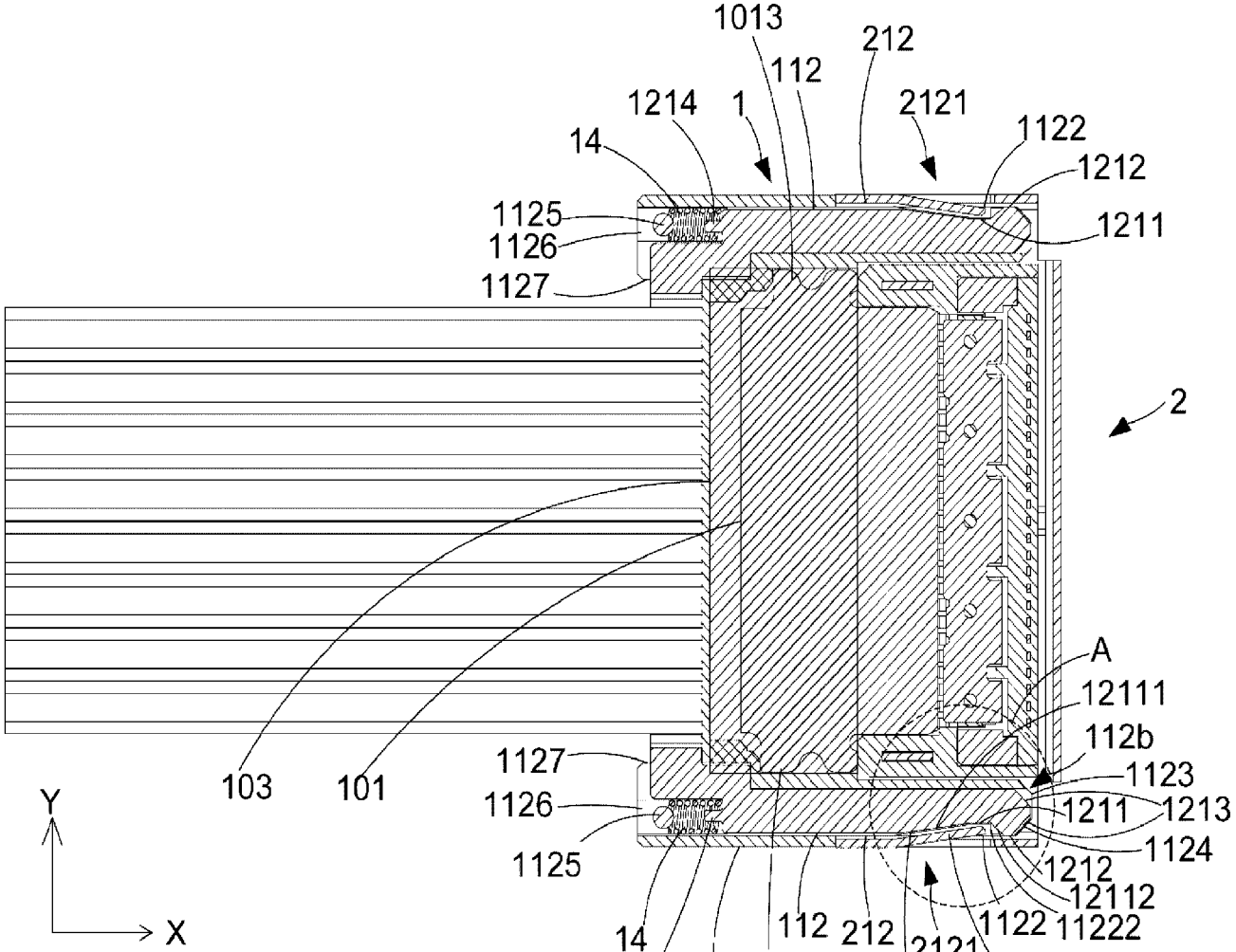
FIG. 4 is a cross-sectional view along line A-A' of FIG. 3.

FIG. 3 is a perspective view of a connector assembly of an embodiment of the present disclosure. FIG. 4 is a cross-sectional view along line A-A' of FIG. 3. As shown in the figures, when the wire end connector 1 and the board end connector 2 are connected to form a connector assembly, the buckling recesses 1122 of the two buckling bumps 112 of the wire end connector 1, and the wire end buckling parts 1211 of the two unlocking arms 121 are respectively connected with the board end connector 2, which indicates that the wire end connector 1 is locked to the board end connector 2. When the unlocking member 12 is pulled, the two unlocking parts 1212 of the unlocking member 12 respectively disconnect the connection between the buckling recesses 1122 of the two buckling bumps 112 and the board end connector 2 and the connection between the wire end buckling parts 1211 of the two unlocking arms 121 and the board end connector 2, which releases the connection between wire end connector 1 and the board end connector 2 so that the wire end connector 1 would be detached from the board end connector 2.

Figure 5:
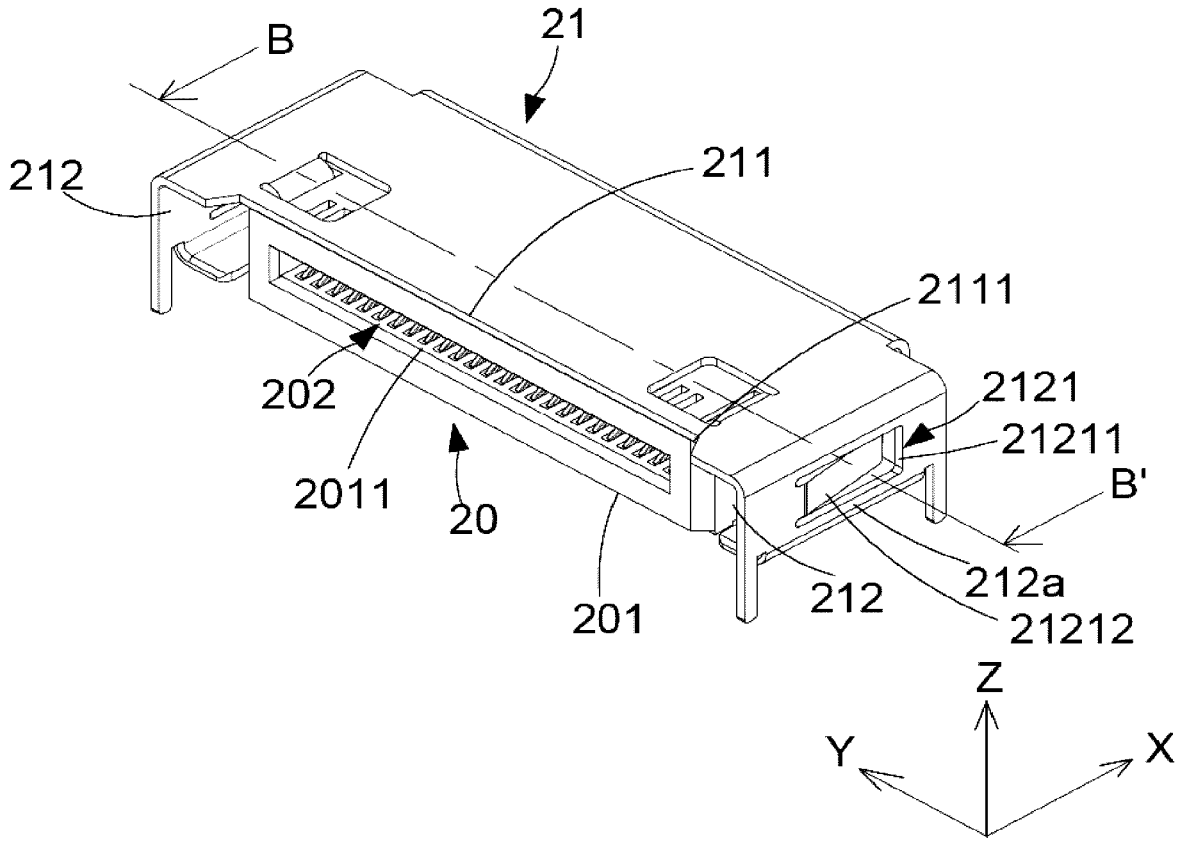
FIG. 5 is a perspective view of a board end connector of an embodiment of the present disclosure.
Figure 6:
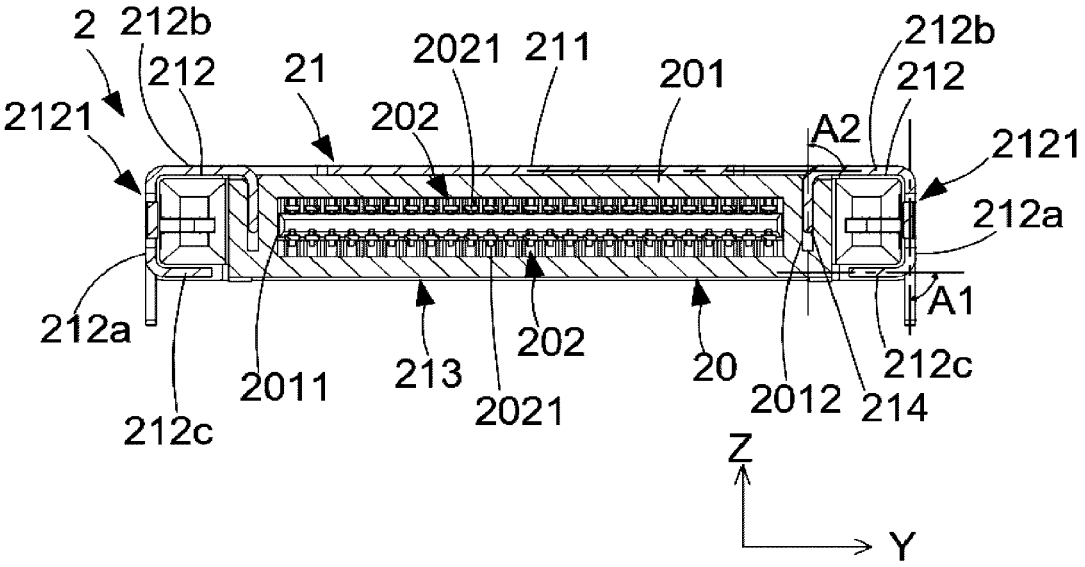
FIG. 6 is a cross-sectional view along line B-B' of FIG. 5.

FIG. 5 is a perspective view of a board end connector of an embodiment of the present disclosure. FIG. 6 is a cross-sectional view along line B-B' of FIG. 5. As shown in the figures, in this embodiment, the board end connector 2 comprises a board end connector body 20 and a board end housing 21. The board end housing 21 comprises a board end accommodating part 211 and two buckling slots 212. One side of the board end accommodating part 211 in the first direction X comprises a board end opening 2111. The two buckling slots 212 are oppositely disposed on two sides of the board end accommodating part 211. The board end connector body 20 is disposed in the board end accommodating part 211. A sidewall 212*a* of the two buckling slots 212 in the second direction Y and away from the board end accommodating part 211 respectively comprise a board end buckling part 2121.

Referring to FIG. 3 and FIG. 4 again, when the wire end connector 1 is connected with the board end connector 2, the two buckling bumps 112 of the wire end connector 1 would respectively enter the two buckling slots 212. The two board end buckling parts 2121 of the board end connector 2 are respectively disposed in the buckling recesses 1122 of the two buckling bumps 112. The two board end buckling parts 2121 would restrict the movement of the wire end buckling parts 1211 of the two unlocking arms 121 of the two buckling bumps 112 in the first direction X and the second direction Y, allowing the wire end connector 1 to be locked with the board end connector 2. Besides, as the unlocking parts 1212 of the two unlocking arms 121 of the two buckling bumps 112 respectively abut against the two board end buckling parts 2121 of the board end connector 2, the wire end connector 1 would be disconnected with the board end connector 2.

The configuration of the wire end connector 1 and the board end connector 2 would be described in detail below. As shown in FIG. 1, FIG. 2, and FIG. 4, the two buckling bumps 112 of the wire end housing 11 of the wire end connector 1 respectively comprise an accommodating through groove 1123 extending along the first direction X. The accommodating through groove 1123 penetrates the first end 112*a* and the second end 112*b* of the buckling bump 112. The accommodating through groove 1123 communicates with the corresponding buckling recess 1122. The two unlocking arms 121 of the unlocking member 12 are movably disposed in the corresponding accommodating through grooves 1123. The two unlocking arms 121 of the unlocking member 12 could move in the corresponding accommodating through grooves 1123.

Figure 7:
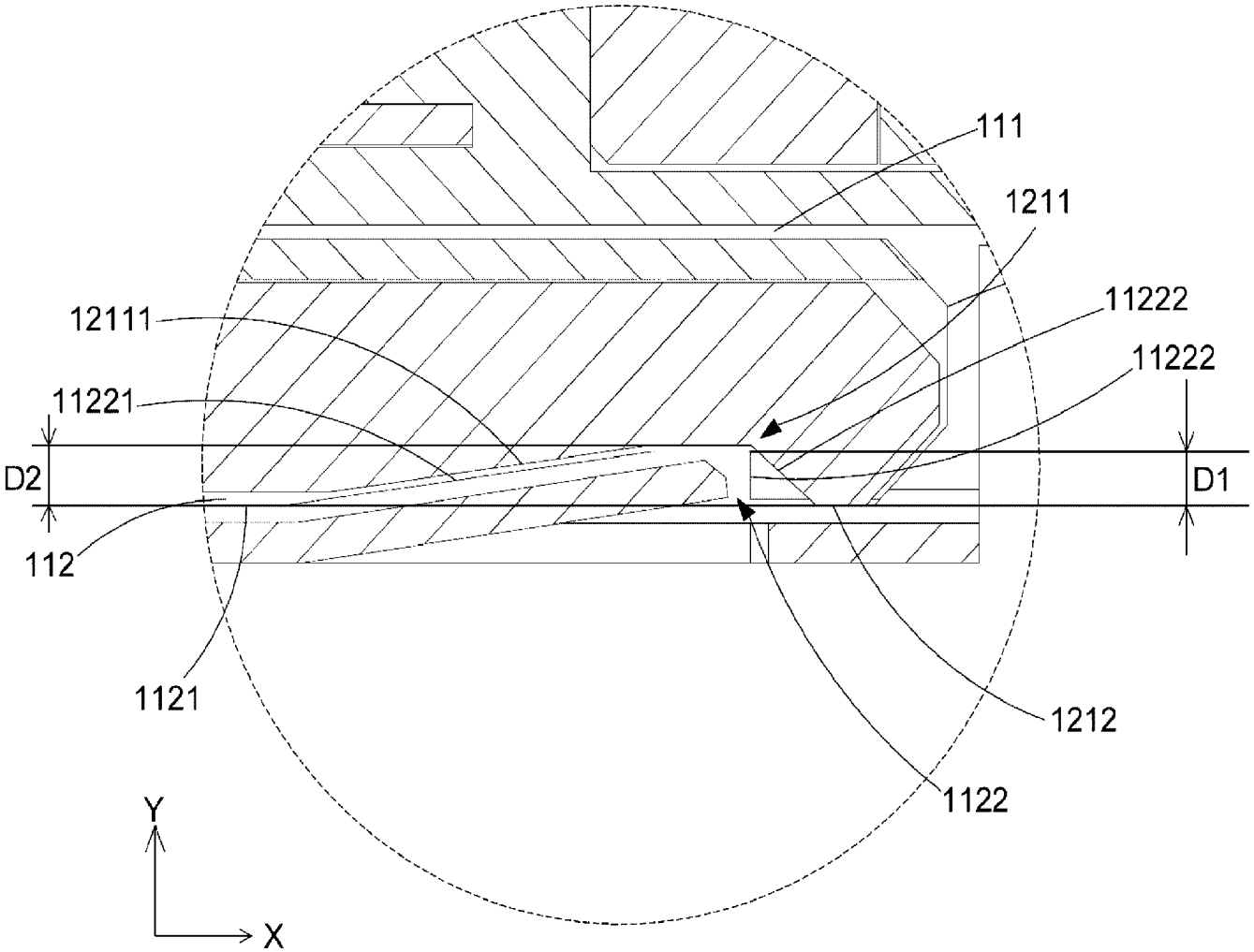
FIG. 7 is an enlarged view of area A of FIG. 4.

FIG. 7 is an enlarged view of area A of FIG. 4. As shown in the figure, the buckling recess 1122 comprises a first limiting sidewall 11221 and a second limiting sidewall 11222 in the first direction X. The second limiting sidewall 11222 is farther than the first limiting sidewall 11221 from the wire end accommodating part 111. In this embodiment, the first limiting sidewall 11221 is inclined to the first direction X, the second limiting sidewall 11222 is orthogonal to the first direction X. A distance D1 between one end of the first limiting sidewall 11221 close to the wire end accommodating part 111 and an outer surface 1121 of the buckling bump 112 in the second direction Y and away from the wire end accommodating part 111 is greater than the distance between one end of the first limiting sidewall 11221 away from the wire end accommodating part 111 and the outer surface 1121 of the buckling bump 112 in the second direction Y and away from the wire end accommodating part 111. In this embodiment, one end of the first limiting sidewall 11221 away from the wire end accommodating part 111 is coplanar with the outer surface 1121 of the buckling bump 112 in the second direction Y and away from the wire end accommodating part 111. Thus, the distance between one end of the first limiting sidewall 11221 away from the wire end accommodating part 111 and the outer surface 1121 of the buckling bump 112 in the second direction Y and away from the wire end accommodating part 111 is zero, which is not shown in FIG. 7. The distance between one end of the first limiting sidewall 11221 away from the wire end accommodating part 111 and the outer surface 1121 of the buckling bump 112 in the second direction Y and away from the wire end accommodating part 111 could be greater than zero but still needs to be smaller than the distance D1 between one end of the first limiting sidewall 11221 close to the wire end accommodating part 111 and an outer surface 1121 of the buckling bump 112 in the second direction Y and away from the wire end accommodating part 111.

The shape of the wire end buckling part 1211 of the two unlocking arms 121 matches the shape of the buckling recess 1122. The wire end buckling part 1211 is a notch and comprises a first limiting side edge 12111 and a second limiting side edge 12112 in the first direction X. The first limiting side edge 12111 corresponds to the first limiting sidewall 11221, and the second limiting side edge 12112 corresponds to the second limiting sidewall 11222.

As shown in FIG. 3 to FIG. 5, the board end buckling parts 2121 of the two buckling slots 212 of the board end housing 21 respectively comprise a retaining opening 21211 and a buckling elastic piece 21212. The retaining opening 21211 penetrates the sidewall 212*a* of the buckling slot 212 in the second direction Y and away from the board end accommodating part 211. One end of the buckling elastic piece 21212 is connected with a side edge of the retaining opening 21211 in the first direction X and close to the board end accommodating part 211. The buckling elastic piece 21212 extends in a direction away from the board end accommodating part 211. The buckling elastic piece 21212 is inclined to the sidewall 212*a* of the buckling slot 212 in the second direction Y and away from a sidewall 212*a*, and is bent into the buckling slot 212.

When the wire end connector 1 is connected with the board end connector 2, the two buckling bumps 112 of the wire end connector 1 would respectively enter the two buckling slots 212, the two buckling elastic pieces 21212 of the board end connector 2 would be respectively disposed in the buckling recesses 1122 of the two buckling bumps 112 and disposed on one side of the first limiting sidewall 11221, and the buckling elastic pieces 21212 of the two board end buckling parts 2121 would respectively correspond to the first limiting side edge 12111 of the two wire end buckling parts 1211. In this way, the buckling elastic pieces 21212 of the two board end buckling parts 2121 could respectively restrict the two buckling bumps 112 and the two unlocking arms 121 to only move in the second direction Y, and to restrict the wire end connector 1 to only move in the second direction Y relative to the board end connector 2.

An end surface of the other ends of the buckling elastic piece 21212 of the two board end buckling parts 2121 respectively correspond to the second limiting sidewall 11222 of the two buckling recesses 1122 and the second limiting side edge 12112 of the two wire end buckling parts 1211. At this time, the buckling elastic piece 21212 is inclined to the sidewall 212*a* of the buckling slot 212 in the second direction Y and away from a sidewall 212*a*, and is bent into the buckling slot 212, which indicates that the buckling elastic piece 21212 is disposed in the buckling recess 1122. In this way, the end surfaces of the other ends of the buckling elastic pieces 21212 of the two board end buckling parts 2121 could respectively restrict the two buckling bumps 112 and the two unlocking arms 121 to only move in the first direction X, which also restricts the terminal connector 1 to only move in the first direction X relative to the board end connector 2, preventing the wire end connector 1 from detaching from the board end connector 2.

As shown in FIG. 2 and FIG. 4, the unlocking parts 1212 of the two unlocking arms 121 of the unlocking member 12 are disposed on one side of the wire end buckling part 1211 away from the wire end accommodating part 111. The unlocking part 1212 is connected with the second limiting side edge 12112. To detach the wire end connector 1 from the board end connector 2, simply pull the unlocking member 12. The unlocking member 12 would move along the first direction X and in a direction away from the board end connector 2. The unlocking parts 1212 of the two unlocking arms 121 would respectively pass through the buckling recesses 1122 of the two locking bumps 112. The unlocking parts 1212 of the two unlocking arms 121 respectively move and protrude from the first limiting sidewalls 11221 of the two buckling recesses 1122. The two unlocking parts 1212 respectively push the buckling elastic pieces 21212 of the two board end buckling parts 2121 to bend toward the outside of the buckling slot 212, allowing the buckling elastic piece 21212 and the buckling slot 212 to be in the second direction Y and away from the sidewall 212*a* of the board end accommodating part 211. Meanwhile, the unlocking member 12 drives the wire end housing 11 accommodating the wire end connector body 10 to move away from the board end connector 2. The two buckling bumps 112 are detached from the two buckling slots 212 of the board end housing 21 so that the wire end connector 1 and the board end connector 2 can be completely separated. In this embodiment, the unlocking parts 1212 of the two unlocking arms 121 are respectively a plane orthogonal to the second direction Y.

In this embodiment, as shown in FIG. 7, the second limiting side edges 12112 of the two wire end buckling parts 1211 of the two unlocking arms 121 is inclined to the second direction Y. A distance D2 between one side of the second limiting side edge 12112 close to the first limiting side edge 12111 and a side edge of the unlocking arm 121 in the second direction Y is greater than the distance between one side of the second limiting side edge 12112 connected with the unlocking part 1212 and a side edge of the unlocking arm 121 in the second direction Y. In this embodiment, one side of the second limiting side edge 12112 connected with the unlocking part 1212 is coplanar with a side edge of the unlocking arm 121 in the second direction Y. In this way, the distance between one side of the second limiting side edge 12112 connected with the unlocking part 1212 and a side edge of the unlocking arm 121 in the second direction Y is zero, which is not shown in FIG. 7. The distance between one side of the second limiting side edge 12112 connected with the unlocking part 1212 and a side edge of the unlocking arm 121 in the second direction Y can be greater than zero, but still needs to be smaller than the distance D2 between one side of the second limiting side edge 12112 close to the first limiting side edge 12111 and a side edge of the unlocking arm 121 in the second direction Y. Thus, the second limiting side edge 12112 is inclined to the second limiting sidewall 11222 of the buckling recess 1122, the inclining direction of the second limiting side edge 12112 is opposite to the inclining direction of the first limiting sidewall 11221, and the second limiting side edge 12112 is disposed in the accommodating through groove 1123.

Figure 8:
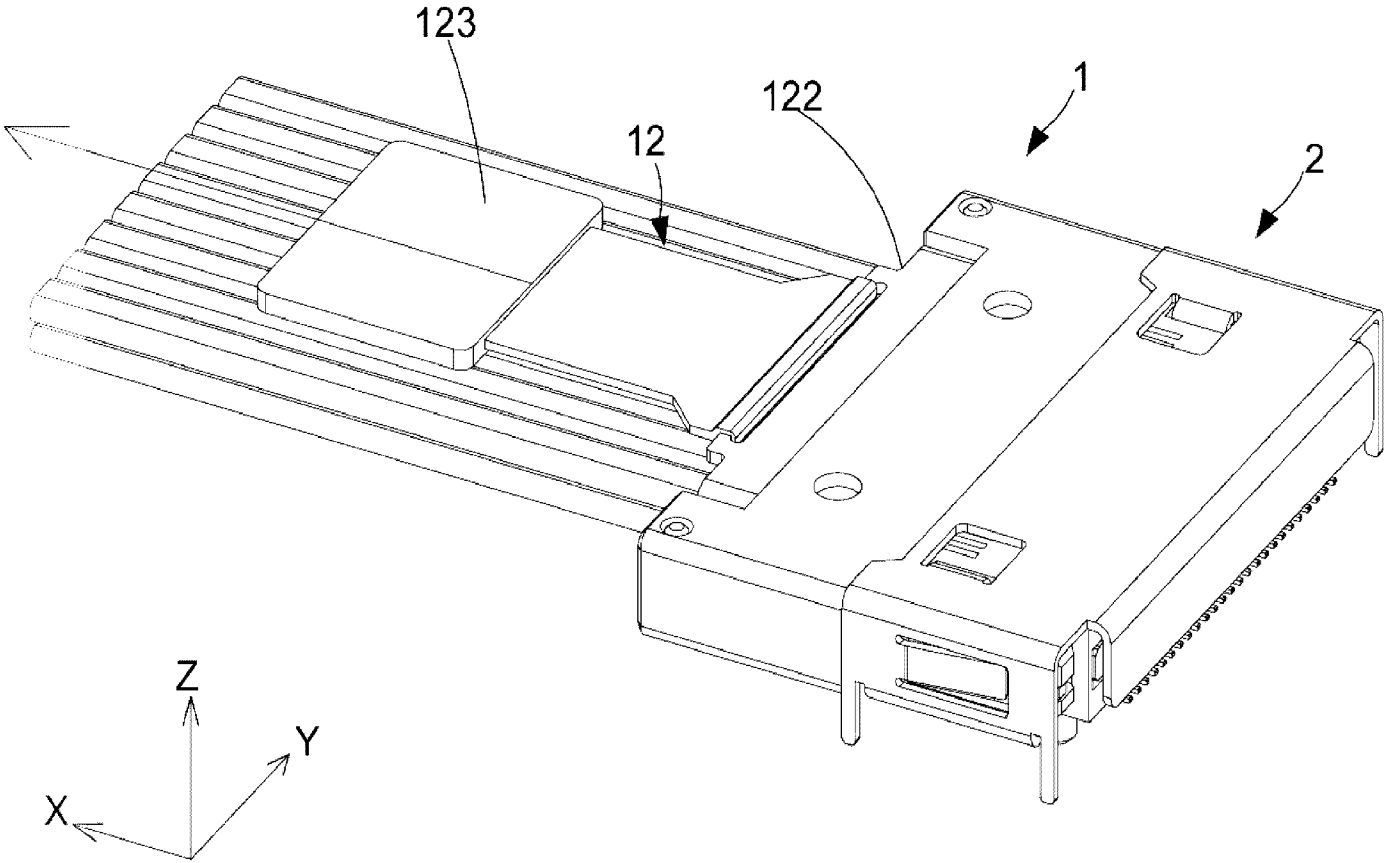
FIG. 8 is an action perspective view of a connector assembly of an embodiment of the present disclosure.
Figure 9:
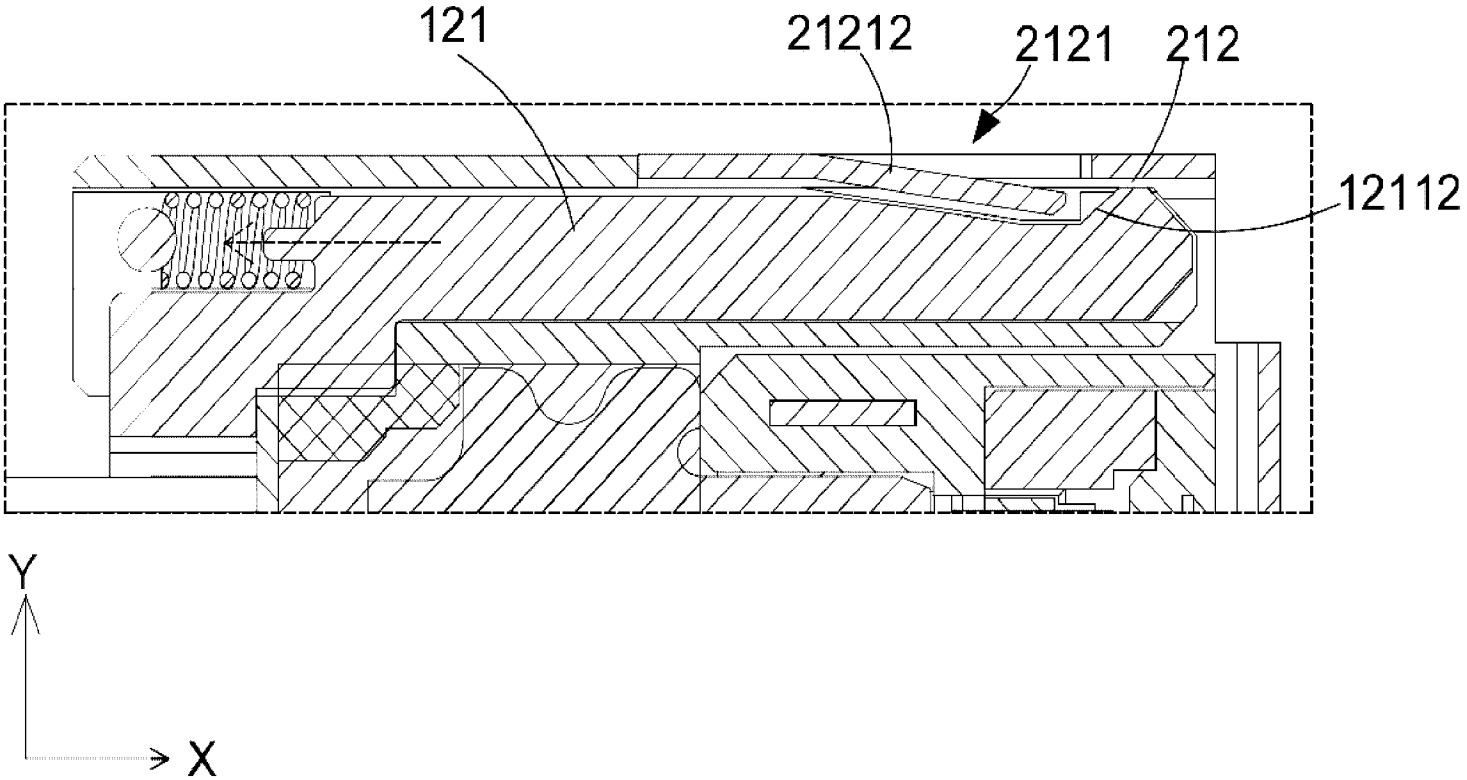
FIG. 9 is a partial cross-sectional view of a connector assembly of an embodiment of the present disclosure.
Figure 10:
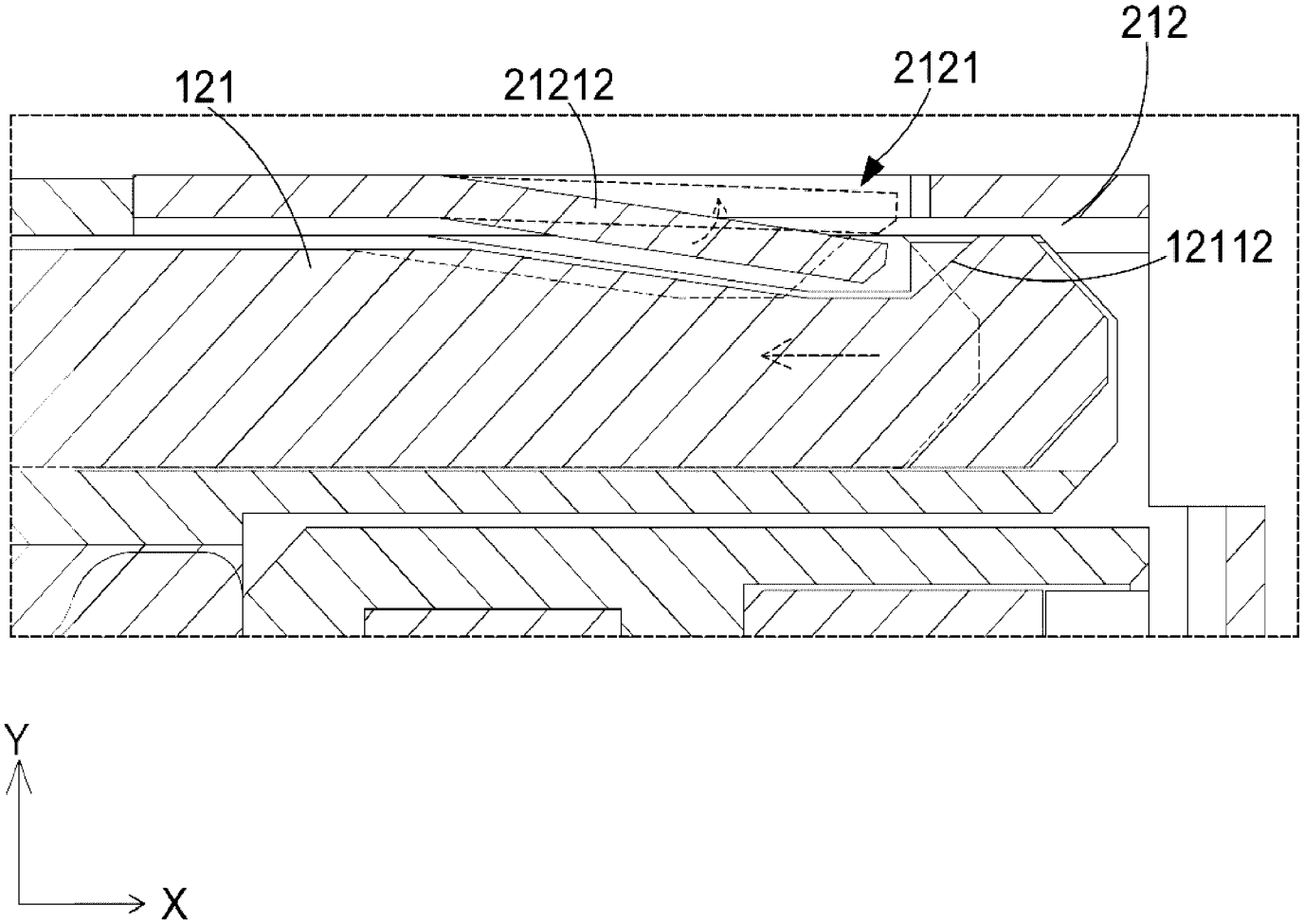
FIG. 10 is a schematic diagram of the action of the unlocking part and the buckling elastic piece of an embodiment of the present disclosure.

FIG. 8 and FIG. 9 are action perspective view and partial cross-sectional view of a connector assembly of an embodiment of the present disclosure. FIG. 10 is a schematic diagram of the action of the unlocking part and the buckling elastic piece of an embodiment of the present disclosure. As shown in the figures, when the unlocking member 12 moves away from the board end connector 2, the second limiting side edges 12112 of the two unlocking arms 121 would be respectively in contact with an end surface of the buckling elastic pieces 21212 of the two board end buckling parts 2121. When the unlocking member 12 continues to move away from the board end connector 2, the end surfaces of the buckling elastic pieces 21212 of the two board end buckling parts 2121 would be respectively bent to the outside of the buckling slot 212 along the second limiting side edge 12112 of the two unlocking arms 121. Finally, the unlocking parts 1212 of the two unlocking arms 121 would be in contact with the buckling elastic pieces 21212 of the two board end buckling parts 2121. At this time, the buckling elastic pieces 21212 of the two board end buckling parts 2121 are bent to the outside of the buckling slot 212 to the greatest extent, so the second limiting side edge 12112 of the two unlocking arms 121 could function as a guiding component.

In this embodiment, four surfaces of the second end 112*b* of the two buckling bumps 112 away from the wire end accommodating part 111 in the first direction X and the second direction Y respectively comprise a guiding inclined surface 1124, through which the size of the second end 112*b* of the two buckling bumps 112 can be reduced, allowing the two buckling bumps 112 to be respectively inserted into the two buckling slots 212 without obstruction. The inclining direction of the guiding inclined surface 1124 of the second end 112*b* of the two buckling bumps 112 in the second direction Y and away from the board end accommodating part 211 is the same as the inclining direction of the buckling elastic pieces 21212 of the two board end buckling parts 2121.

When the second ends 112*b* of the two buckling bumps 112 pass through the two board end buckling parts 2121, the guiding inclined surface 1124 of the second end 112*b* of the two buckling bumps 112 in the second direction Y and away from the board end accommodating part 211 would be moving relative to the buckling elastic pieces 21212 of the two board end buckling parts 2121 and would push the buckling elastic pieces 21212 of the two board end buckling parts 2121 to bend toward the outside of the buckling slot 212, allowing the two buckling bumps 112 to pass through the buckling elastic pieces 21212 of the two plate end buckling parts 2121 without obstruction and to be are disposed in the two buckling slots 212. In this embodiment, two opposite sides of the two unlocking arms 121 in the second direction Y away from the buckling end 121*b* of the wire end accommodating part 111 comprises a chamfer 1213 preventing the buckling ends 121*b* of the two unlocking arms 121 from protruding from the two buckling bumps 112.

In one embodiment, as shown in FIG. 2 and FIG. 4, the wire end connector 1 further comprises two elastic members 14, which are respectively disposed in the two accommodating through grooves 1123. One ends of the two elastic members 14 respectively abut against the connecting ends 121*a* of the two unlocking arms 121. The other ends of the two elastic members 14 respectively abut against the first ends 112*a* of the two buckling bumps 112. When the two unlocking arms 121 are pushed to approach the wire end accommodating part 111 along the first direction X, the two unlocking arms 121 would respectively compress the two elastic pieces 14. When stop pushing, the two compressed elastic members 14 would be released, and the elastic force of the two elastic members 14 would respectively push the two unlocking arms 121 to move away from the wire end accommodating part 111 along the first direction X. In this way, the two unlocking arms 121 can be automatically restored to the initial position, allowing the unlocking member 12 to be automatically restored to the initial position.

In this embodiment, as shown in FIG. 2 and FIG. 4, the connecting ends 121*a* of the two unlocking arms 121 respectively comprise a positioning column 1214. The positioning column 1214 extends away from the buckling end 121*b* along the first direction X. One end of the positioning column 1214 away from the buckling end 121*b* penetrates into the corresponding elastic member 14. The positions where the two elastic members 14 abut against the connecting ends 121*a* of the two unlocking arms 121 can be positioned through the positioning column 1214. In this embodiment, the two buckling bumps 112 further comprise a limiting column 1125 respectively. The limiting column 1125 is disposed in the corresponding accommodating through groove 1123 and is disposed at the first end 112*a* of the corresponding buckling bump 112. In this embodiment, the two limiting columns 1125 extend along the third direction Z. Two ends of the two limiting columns 1125 are respectively connected with two opposite sidewalls of the two accommodating through grooves 1123 in the third direction Z. The other ends of the two elastic members 14 respectively abut against the two limiting columns 1125. The positions where the two elastic members 14 abut against the first ends 112*a* of the two buckling bumps 112 can be positioned through the limiting column 1125. Wherein the third direction Z is orthogonal to the first direction X and the second direction Y. In this embodiment, the elastic member 14 is a spring.

In this embodiment, the two limiting columns 1125 are movably disposed on the two buckling bumps 112 respectively, which indicates that the two limiting columns 1125 can be assembled on the two buckling bumps 112, and can also be disassembled from the two buckling bumps 112.

In this embodiment, two opposite sidewalls of the two accommodating through grooves 1123 in the third direction Z respectively comprise a through hole 11231. Two ends of the two limiting columns 1125 are respectively disposed in the two through holes 11231 of the two accommodating through grooves 1123. The first ends 112*a* of the two buckling bumps 112 respectively comprise an elastic member insertion hole 1126. The two elastic members 14 can be respectively inserted into the two accommodating through grooves 1123 through the elastic member insertion holes 1126 of the two buckling bumps 112 for assembling. In practice, two elastic members 14 are respectively disposed in the two accommodating through grooves 1123 through the elastic member insertion holes 1126, then the two limiting columns 1125 are respectively disposed in the two accommodating through grooves 1123 through the two through holes 11231. The two limiting columns 1125 are disposed in the elastic member insertion holes 1126 to prevent the elastic member 14 from protruding from the elastic member insertion hole 1126.

As shown in FIG. 1 and FIG. 2, in this embodiment, the unlocking member 12 further comprises a buckling connecting piece 122, and two ends of which are respectively connected with the connecting ends 121*a* of the two unlocking arms 121. When the unlocking member 12 is disposed at one side of the wire end housing 11 away from the wire end opening 1111, the buckling connecting piece 122 would be disposed at one side of the wire end housing 11 away from the wire end opening 1111. In this embodiment, one side of the wire end housing 11 away from the wire end opening 1111 further comprises a retaining notch 113. The first ends 112*a* of the two buckling bumps 112 are disposed on two sides of the retaining notch 113. When the unlocking member 12 is disposed on one side of the wire end housing 11 away from the wire end opening 1111, the buckling connecting piece 122 would be disposed in the retaining notch 113 to prevent the buckling connecting piece 122 from protruding from one side of the wire end housing 11 away from the wire end opening 1111. As shown in FIG. 4, the first ends 112*a* of the two buckling bumps 112 comprises a connecting opening 1127 on a surface close to the retaining notch 113 in the second direction Y. The connecting opening 1127 is in communication with the accommodating through groove 1123. The joints between the two unlocking arms 121 and the buckling connecting piece 122 are respectively in the connecting openings 1127 of the two buckling bumps 112.

As shown in FIG. 1, FIG. 2, and FIG. 8, the unlocking member 12 of this embodiment further comprises an activation piece 123, one end of which is connected with the buckling connecting piece 122. The two unlocking arms 121 can be pulled by pulling the activation piece 123, which is convenient for operation. In this embodiment, the activation piece 123 is a puller strap.

Figure 11:
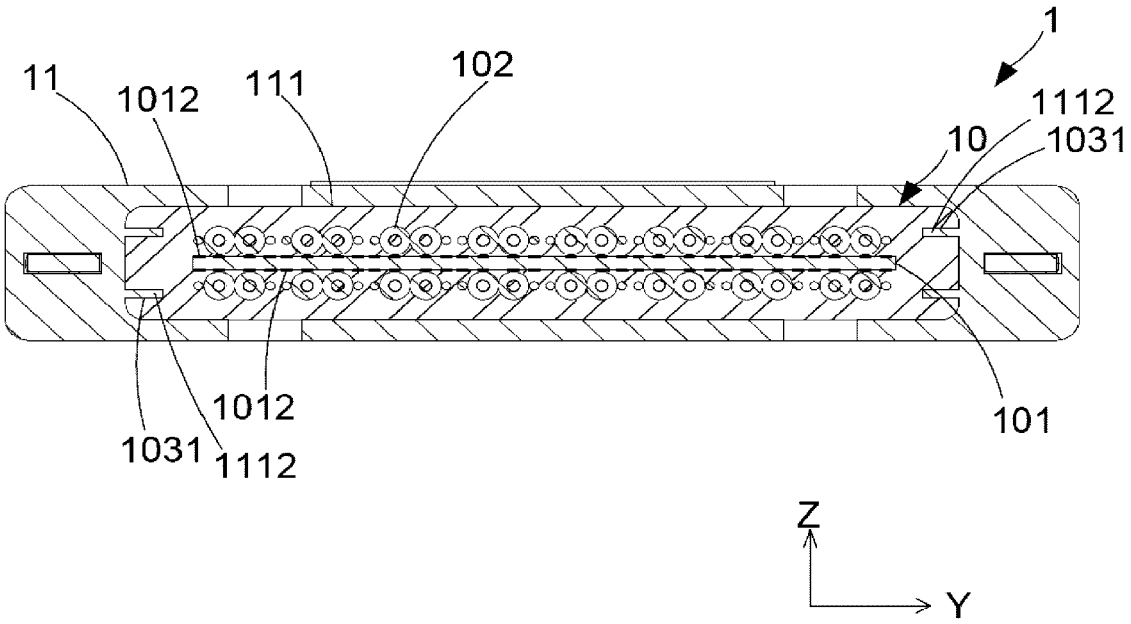
FIG. 11 is a cross-sectional view along line C-C' of FIG. 1.

FIG. 11 is a cross-sectional view along line C-C' of FIG. 1. Referring to FIG. 11 with FIG. 1 and FIG. 2, the wire end connector body 10 of this embodiment comprises a circuit board 101, a plurality of cables 102, and a wire end insulating body 103. The circuit board 101 comprises a plurality of contacting pads 1011 and a plurality of cable connecting pads 1012. The plurality of contacting pads 1011 are arranged in a row at intervals along the second direction Y. The plurality of cable connecting pads 1012 are arranged in a row at intervals along the second direction Y. The plurality of contacting pads 1011 arranged in a row and the plurality of cable connecting pads 1012 arranged in a row are arranged on two opposite sides of the circuit board 101 along the first direction X. The plurality of cables 102 are connected with the plurality of cable connecting pads 1012. The wire end insulating body 103 covers the joints between the plurality of cables 102 and the plurality of cable connecting pads 1012 and a part of the circuit board 101. One side of the circuit board 101 comprising a plurality of contacting pads 1011 is exposed from the terminal insulating body 103.

When the wire end connector body 10 of this embodiment is disposed in the wire end accommodating part 111 of the wire end housing 11, the wire end insulating body 103 would be disposed in the wire end accommodating part 111, One side of the circuit board 101 comprising a plurality of contacting pads 1011 would protrude from the wire end opening 1111 of the wire end housing 11, and the plurality of cables 102 would protrude from one side of the wire end housing 11 away from the wire end opening 1111. In this embodiment, two opposite sides of the wire end insulating body 103 in the second direction Y further comprises a positioning recess 1031. Two opposite sidewalls of the wire end accommodating part 111 of the wire end housing 11 in the second direction Y further comprises a positioning bump 1112. The positioning bump 1112 is disposed in the positioning recess 1031 to secure the wire end insulating body 103 in the wire end accommodating part 111 of the wire end housing 11, allowing the wire end housing 11 to be firmly connected with the terminal insulating body 103. As shown in FIG. 4, in this embodiment, two opposite sides of the circuit board 101 in the second direction Y further comprises an interfering bump 1013. The interfering bump 1013 interferes with the terminal insulating body 103, which increases the connection stability between the circuit board 101 and the terminal insulating body 103. In this embodiment, the wire end insulating body 103 and the wire end housing 11 are produced by injection molding.

As shown in FIG. 5 and FIG. 6, the board end connector body 20 of this embodiment comprises a board end insulating body 201 and two terminal modules 202. The board end insulating body 201 comprises a slot 2011. The two terminal modules 202 are disposed in the slot 2011 along the third direction Z in a stacked manner. A bottom surface of the board end accommodating part 211 of the board end housing 21 in the third direction Z comprises a notch 213. The two terminal modules 202 respectively comprise a plurality of terminals 2021. One ends of the plurality of terminals 2021 is disposed in the slot 2011. The other ends of the plurality of terminals 2021 are exposed from the notch 213 to connect with an external circuit board.

In this embodiment, the two buckling slots 212 of the board end housing 21 further comprise a top surface 212*b* in the third direction Z. One side of the top surface 212*b* is connected with one side of the sidewall 212*a*. The sidewall 212*a* is orthogonal to the top surface 212*b*. The inner sides of the two buckling slots 212 of the board end housing 21 respectively comprise an extending support piece 212*c* extending in the second direction. One side of the extending support piece 212*c* is connected with the other side of the sidewall 212*a* and corresponds to the top surface 212*b*. That is, the extending support piece 212*c* and the top surface 212*b* are disposed in the third direction at intervals, and the other side of the extending support piece 212*c* is suspended. When the two buckling bumps 112 of the wire end connector 1 are respectively disposed in the two buckling slots 212, the extending support piece 212*c* would support the corresponding buckling bump 112. A first angle A1 is formed between the extending support piece 212*c* and the sidewall 212*a*. In this embodiment, the first angle A1 is 90 degrees, that is, the extending support piece 212*c* is orthogonal to the sidewall 212*a*. The first angle A1 can be smaller than 90 degrees to reduce the distance between the extending support piece 212*c* and the top surface 212*b*. When the two buckling bumps 112 of the wire end connector 1 are respectively disposed in the two buckling slots 212, the extending support piece 212*c* and the top surface 212*b* would restrict the buckling bump 112 to only move in the third direction Z.

The top surface of the board end accommodating part 211 of the board end housing 21 further comprises two positioning pieces 214 extending into the board end accommodating part 211 along the third direction Z. The top surface of the board end insulating body 201 of the board end connector body 20 further comprises two positioning grooves 2012 in the third direction Z. The two positioning grooves 2012 extend along the third direction Z. When the board end connector body 20 is disposed in the board end accommodating part 211, the two positioning pieces 214 would be respectively disposed in the two positioning grooves 2012 to position the board end connector body 20 in the board end accommodating part 211. In this embodiment, a second angle A2 is respectively formed between the two positioning pieces 214 and the top surface of the board end accommodating part 211 of the board end housing 21. In this embodiment, the second angle A2 is 90 degrees, that is, the two positioning pieces 214 are respectively orthogonal to the top surface of the board end accommodating part 211 of the board end housing 21. In other embodiments, the second angle A2 could be smaller than 90 degrees, so that the two positioning pieces 214 could respectively abut against the sidewalls of the two positioning slots 2012 close to the buckling slot 212. Thus, the board end connector body 20 can be effectively secured in the board end accommodating part 211.

In summary, embodiments of the present disclosure provide a board end connector and a connector assembly. The buckling slot of the board end connector is disposed at one side of the board end connector body. The buckling slot is provided for insertion of the two buckling bumps and two unlocking arms of the wire end connector. The two board end buckling parts, the buckling recesses of the two buckling bumps, and the wire end buckling parts and the unlocking parts of the two unlocking arms horizontally move. Thus, the thickness of the board end connector in the vertical direction would not be increased, allowing the thickness of the board end connector to be thinned.

The buckling slot of the board end connector of the present disclosure further comprises an extending support piece to support the buckling bump, allowing the buckling bump to be firmly disposed in the buckling slot. The board end accommodating part of the board end connector of the present disclosure further comprises a positioning piece. The board end connector body further comprises a positioning groove. The positioning piece is disposed in the positioning groove, so that the board end connector body could be firmly disposed in the board end accommodating part.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A board end connector, comprising:

a board end connector body comprising a board end insulating body and two positioning grooves; and a board end housing comprising a board end accommodating part, a buckling slot and two positioning pieces;

wherein the board end accommodating part accommodates the board end connector body, each of the two positioning grooves is formed on a top surface facing the board end housing of the board end insulating body and has an opening toward to a direction of the top surface, the two positioning pieces extend into the board end accommodating part and are disposed in the two positioning grooves through the opening of each of the positioning grooves respectively.

2. The board end connector according to claim 1, wherein the inner sides of the buckling slot respectively comprise a top surface disposed along the third direction at intervals and an extending support piece opposite to the top surface; one side of the top surface is connected with one side of the sidewall; the top surface is orthogonal to the sidewall; one side of the extending support piece is connected with the other side of the sidewall; the other side of the extending support piece is suspended.

3. The board end connector according to claim 2, wherein a first angle is formed between the extending support piece and the sidewall; the first angle is less than or equal to 90 degrees.

4. The board end connector according to claim 1, wherein the board end connector body comprises two terminal modules; the board end insulating body comprises a slot; the two terminal modules are disposed in the slot in a stacked manner.

5. The board end connector according to claim 1, wherein the two positioning pieces are disposed opposite to the sidewalls.

6. The board end connector according to claim 1, wherein a second angle is formed between the two positioning pieces and the top surface of the board end accommodating part; the second angle is less than or equal to 90 degrees.

7. The board end connector according to claim 1, wherein the board end housing further comprises two openings adjacent to the positioning pieces, and each of the positioning pieces is connected to one edge of the openings respectively.

8. The board end connector according to claim 1, wherein the buckling slot is disposed at one side of the board end accommodating part; a buckling bump is provided in the buckling slot; a wall of the buckling bump comprises a board end buckling part; the board end buckling part comprises a buckling elastic piece; one end of the buckling elastic piece is connected with a side edge of the wall; the other end of the buckling elastic piece extends in a direction away from the board end accommodating part and is bent into the buckling slot.

* * * * *